US007566393B2

(12) United States Patent
Klabunde et al.

(10) Patent No.: US 7,566,393 B2
(45) Date of Patent: Jul. 28, 2009

(54) METHOD OF SORBING SULFUR COMPOUNDS USING NANOCRYSTALLINE MESOPOROUS METAL OXIDES

(75) Inventors: Kenneth Klabunde, Manhatan, KS (US); Bill R. Sanford, Naples, FL (US); P. Jeevanandam, Manhattan, KS (US)

(73) Assignee: NanoScale Corporation, Manhattan, KS (US)

( * ) Notice: Subject to any disclaimer, the term of this patent is extended or adjusted under 35 U.S.C. 154(b) by 774 days.

(21) Appl. No.: 11/114,989

(22) Filed: Apr. 26, 2005

(65) Prior Publication Data

US 2005/0205469 A1 Sep. 22, 2005

Related U.S. Application Data

(62) Division of application No. 10/600,309, filed on Jun. 20, 2003, now Pat. No. 7,341,977.

(51) Int. Cl.

| | |
|---|---|
| ***C10G 25/00*** | (2006.01) |
| ***B01J 23/00*** | (2006.01) |
| ***B01J 21/00*** | (2006.01) |
| ***B01J 20/00*** | (2006.01) |
| ***B01J 29/00*** | (2006.01) |

(52) U.S. Cl. ..... 208/208 R; 208/213; 208/217; 208/299; 502/242; 502/243; 502/244; 502/245; 502/258; 502/259; 502/260; 502/261; 502/262; 502/304; 502/325; 502/326; 502/327; 502/328; 502/329; 502/330; 502/331; 502/332; 502/333; 502/334; 502/335; 502/336; 502/337; 502/339; 502/340; 502/341; 502/342; 502/343; 502/344; 502/345; 502/346; 502/347; 502/348; 502/349; 502/350; 502/351; 502/352; 502/355; 502/407; 502/415; 502/439

(58) Field of Classification Search ..... 502/242–244, 502/258–262, 304, 325–355, 407, 415, 439; 208/208 R, 213, 217, 299
See application file for complete search history.

(56) References Cited

U.S. PATENT DOCUMENTS

| | | | | |
|---|---|---|---|---|
| 3,245,919 | A * | 4/1966 | Mooi et al. | 502/314 |
| 4,119,571 | A * | 10/1978 | Hegedus et al. | 502/333 |
| 4,171,260 | A | 10/1979 | Farcasiu et al. | |
| 4,179,361 | A | 12/1979 | Michlmayr | |

(Continued)

OTHER PUBLICATIONS

Title: Decomposition Kinetics of Alkaline-Earth Hydroxides and Surface Area of Their Calcine; Authors: M. Hartman, O. Trnka, K. Svoboda and J. Kocurek; Date: 1994; pp. 1209-1216.

(Continued)

*Primary Examiner*—Cam N. Nguyen
(74) *Attorney, Agent, or Firm*—Hovey Williams LLP

(57) ABSTRACT

Compounds and methods for sorbing organosulfur compounds from fluids are provided. Generally, compounds according to the present invention comprise mesoporous, nanocrystalline metal oxides. Preferred metal oxide compounds either exhibit soft Lewis acid properties or are impregnated with a material exhibiting soft Lewis acid properties. Methods according to the invention comprise contacting a fluid containing organosulfur contaminants with a mesoporous, nanocrystalline metal oxide. In a preferred embodiment, nanocrystalline metal oxide particles are formed into pellets (14) and placed inside a fuel filter housing (12) for removing organosulfur contaminants from a hydrocarbon fuel stream.

20 Claims, 2 Drawing Sheets

U.S. PATENT DOCUMENTS 4,188,285 A 2/1980 Michlmayr
4,225,417 A 9/1980 Nelson
4,337,156 A 6/1982 deRosset
4,499,203 A * 2/1985 Toulhoat et al. ..... 502/247
4,634,515 A 1/1987 Bailey et al.
4,744,825 A * 5/1988 Chen et al. ..... 75/733
4,863,521 A 9/1989 Block
5,057,473 A 10/1991 Voecks et al.
5,059,304 A * 10/1991 Field ..... 208/99
5,146,039 A 9/1992 Wildt et al.
5,157,201 A * 10/1992 Norris ..... 585/820
5,173,173 A * 12/1992 Vauk ..... 208/91
5,322,615 A 6/1994 Holtermann et al.
5,401,391 A 3/1995 Collins et al.
5,482,617 A 1/1996 Collins et al.
5,759,939 A 6/1998 Klabunde et al.
5,807,475 A 9/1998 Kulprathipanja et al.
5,843,300 A 12/1998 Zinnen et al.
5,925,239 A * 7/1999 Klein et al. ..... 208/213
5,928,496 A * 7/1999 Albers et al. ..... 208/113
5,928,498 A * 7/1999 McVicker et al. ..... 208/213
5,935,420 A * 8/1999 Baird et al. ..... 208/213
5,935,422 A 8/1999 Zinnen
5,977,013 A * 11/1999 Elliott et al. ..... 502/337
6,042,798 A 3/2000 Masuda et al.
6,093,236 A 7/2000 Klabunde et al.
6,096,194 A 8/2000 Tsybulevskiy et al.
6,103,106 A * 8/2000 McVicker et al. ..... 208/213
6,110,862 A * 8/2000 Chen et al. ..... 502/326
6,118,037 A 9/2000 Piccoli et al.
6,221,240 B1 * 4/2001 Klein et al. ..... 208/213
6,231,755 B1 5/2001 Mesher et al.
6,245,221 B1 * 6/2001 Baird et al. ..... 208/213
6,346,190 B1 2/2002 Khare
6,403,526 B1 * 6/2002 Lussier et al. ..... 502/439
6,417,136 B2 * 7/2002 Cheung et al. ..... 502/330
6,429,170 B1 8/2002 Dodwell
6,436,280 B1 * 8/2002 Harle et al. ..... 208/216 R
6,495,029 B1 * 12/2002 Schorfheide et al. ..... 208/213
6,524,993 B2 * 2/2003 Yamaguchi et al. ..... 502/328
6,576,588 B2 * 6/2003 Ryu et al. ..... 502/331
6,653,519 B2 * 11/2003 Koper et al. ..... 588/313
6,703,343 B2 * 3/2004 Park ..... 502/355
6,706,660 B2 * 3/2004 Park ..... 502/304
6,717,022 B2 * 4/2004 Ryu et al. ..... 585/261
6,893,553 B1 * 5/2005 Abe et al. ..... 208/208 R
2001/0014304 A1 8/2001 Satokawa
2001/0027163 A1 10/2001 Khare
2001/0029311 A1 10/2001 Khare
2002/0009404 A1 1/2002 Tsybulevskiy
2002/0043484 A1 4/2002 Khare
2002/0052291 A1 5/2002 Siriwardane
2002/0107424 A1 * 8/2002 Cheung et al. ..... 585/275
2002/0111524 A1 8/2002 Minhas
2003/0178343 A1 * 9/2003 Chen et al. ..... 208/213
2004/0004029 A1 * 1/2004 Khare et al. ..... 208/208 R
2005/0098478 A1 * 5/2005 Gupta et al. ..... 208/208 R
2005/0154241 A1 * 7/2005 Ryu et al. ..... 585/258
2005/0203320 A1 * 9/2005 Ryu ..... 585/261
2006/0081499 A1 * 4/2006 Khare ..... 208/15

OTHER PUBLICATIONS

Title: Thermal Dehydration of Magnesium Hydroxide and Sintering of Nascent Magnesium Oxide; Authors: M. Hartman,O. Trnka and V. Vesely; Date: Mar. 1994; pp. 536-542.

Title: Heavy Metals of Groups I and II/Zinc Oxide; Authors: Blanchard, Phelan, Davis; Date: 1936, pp: 228-231.

Title: Zinc Oxide and Rubber; Authors: Lloyd Carlson; Date:1983.

Title: Synthesis of Carbon-Coated $M_gO$ Nanoparticles; Authors: Bedilo, Sigel, Koper, Melgunov and Klabunde; Date: 2002; pp. 3599-3604.

Title: Desulfurization of Transportation Fuels with Zeolites Under Ambient Conditions; Science Mag. vol. 301 Jul. 4, 2003 pp. 79-81; Authors: Yang, Ralph T.; Hernandez-Maldonado, Arturo; Yang, Frances.

Title: Zeolites offer high selectivity, high capacity for sulfur removal; C & EN Jul. 2003 p. 17.

* cited by examiner

METHOD OF SORBING SULFUR COMPOUNDS USING NANOCRYSTALLINE MESOPOROUS METAL OXIDES

CROSS REFERENCE TO RELATED APPLICATION

This application is a division of U.S. patent application Ser. No. 10/600,309, filed Jun. 20, 2003, now U.S. Pat. No. 7,341,977 which is incorporated by reference.

BACKGROUND OF THE INVENTION

1. Field of the Invention

The present invention is generally directed towards methods of sorbing sulfur compounds, particularly $H_2S$, $SO_2$, and organosulfur compounds, from a fluid using mesoporous metal oxide compounds. Metal oxide compounds for use with the present invention include porous compounds having soft Lewis acids impregnated therein or sorbed in the pores thereof, carbon coated metal oxide compounds, and porous nanocrystalline metal oxide compounds which themselves exhibit soft Lewis acid properties. The metal oxide compound is contacted with the fluid containing the sulfur compounds.

2. Description of the Prior Art

Sulfur-containing compounds are present in all fractions of crude oil, some constituting up to 2.5% by weight of the particular fraction. These sulfur-containing compounds can poison many catalysts used in chemical processes. In particular, the Group VIII metal catalysts are extremely sensitive to sulfur poisoning. Also, the generation of sulfur oxides during the combustion of sulfur-containing fuels and the oxidation of these oxides to $H_2SO_4$ in automotive exhaust constitutes a major environmental concern to the point that the U.S. Environmental Protection Agency has imposed standards requiring that the maximum sulfur contents of gasoline and diesel fuel be 30 and 15 ppm, respectively, by 2006. These levels are down dramatically from present levels which are as high as several hundred ppm of sulfur compounds.

In oil refineries, an enormous effort is focused on the removal of organosulfur molecules from oil. Generally, such removal is achieved by catalytic processes at high temperatures and pressures. The conventional hydrodesulfurization (HDS) process that is widely used is very efficient for the removal of thiols and sulfides, but is less effective for removal of thiophenes and related derivatives. Therefore, unacceptably high concentrations of organosulfur compounds remain in the fuel stream.

The use of sorbents to remove these remaining portions of organosulfur compounds has been investigated in the past, however no sorbent has been shown to have an enhanced sorption capacity over an extended range of sulfur concentrations and the capability to remove all organosulfur compounds to the desired concentration while being capable of regeneration and production at a low cost.

Generally, the sulfur sorbent materials fall into two categories: (1) chemisorbents which are solid substances that chemically bind sulfur-contaminated compounds, and (2) physisorbents which are solid substances that adsorb the sulfur compounds by weak intermolecular forces, such as van der Waals interaction. Physisorbents, in principle, can work at ambient conditions and have a substantial capacity for removal of sulfur compounds at relatively high concentrations. The main drawback of physisorbents is their inability to reduce sulfur compound concentrations to low levels approaching 15 ppm. Chemisorbents do lower the sulfur content considerably, however the adsorption process must occur at elevated temperatures, about 200°-500° C. and higher. Furthermore, regeneration of chemisorbents is also very difficult and chemisorbents tend not to exhibit the necessary capacity for removing compounds present at high levels.

Combinations of conventional chemisorbents and physisorbents have been suggested to overcome the problems with using purely chemi- or physisorbent materials. However, due to completely different operational temperatures, blended adsorbents demand complicated purification processes which result in higher operational costs. U.S. Pat. No. 5,146,039 discloses the introduction of transition metal ions in a zeolite framework for removal of sulfides and disulfides to levels of 5 ppb at temperatures of 60°-120° C., however, the adsorption capacity for these materials is low. For example, hydrocarbon feeds with sulfur content greater than 20 ppm could not be used with these adsorbents.

As a further illustration of the problems associated with these zeolite compounds, U.S. Pat. No. 5,807,475 describes a zeolite adsorbent (Ni-zeolite-X and Mo-zeolite-X, for example) for thiophene and mercaptan removal from gasoline in the temperature range of 10°-100° C. However, the adsorption capacity is not high, and the sulfur recovery does not exceed 40-50%.

Therefore, there is a real and unfulfilled need in the art for an improved sorbent material which has enhanced sorption capacity over a broad range of sulfur concentrations, has the capability to remove a wide variety of organosulfur compounds, can be easily regenerated, and is cost effective to produce.

SUMMARY OF THE INVENTION

The present invention overcomes the above problems and provides methods and compositions for adsorbing sulfur compounds, especially $H_2S$, $SO_2$, and organosulfur compounds, from a fluid, particularly, a hydrocarbon fluid such as gasoline and diesel fuel. The inventive method employs various compositions to sorb the target sulfur compounds. One such composition comprises a porous first material impregnated with a second material. The first material is selected from the group consisting of metal oxides and metal hydroxides, the second material is selected from the group consisting of metals, metal cations, and metal oxides. As used herein, the term "impregnated" means that the second material has permeated the first material, or that the first material has become infused with the second material. This is to be contrasted with the second material forming a "coating" on the first material, which generally indicates that a layer of material has been deposited on the outer surface of another material.

In addition to merely being porous, the first material may also be classified as "mesoporous" or "macroporous" as opposed to "microporous", indicating a relatively open, fibrous pore structure. The preferred first material has average pore opening sizes of at least about 4 nm and more preferably about 8 nm. Furthermore, the first material should have crystallite sizes (as determined by powder x-ray diffraction) of less than about 15 nm, and more preferably between 2-10 nm. As is conventional in the art, the term "particle" is used herein interchangeably with the term "crystallite". Because of such large pore openings, the first material may be impregnated with the second material without damaging the nanocrystalline structure of the first material.

The first material is preferably a metal oxide selected from the group consisting of MgO, $CeO_2$, AgO, SrO, BaO, CaO, $TiO_2$, $ZrO_2$, FeO, $V_2O_3$, $V_2O_5$, $Mn_2O_3$, $Fe_2O_3$, NiO, CuO, $Al_2O_3$, ZnO, $SiO_2$, $Ag_2O$, and combinations thereof. Most preferably, the metal oxide is MgO, $Al_2O_3$, or an intimate mixture of MgO and $Al_2O_3$ (hereafter referred to as $MgO.Al_2O_3$). The first material should have a Brunauer-Emmett-Teller (BET) multi-point surface area of at least about 100 $m^2/g$, more preferably at least about 200 $m^2/g$, and a pore volume of at least about 0.3 $cm^3/g$, and more preferably at least about 0.8 $cm^3/g$.

Selection of the second material is largely dependent upon the properties of the sulfur target compound which exhibits the property of being a soft Lewis base, a species which exhibits the tendency to act as an electron pair donor. Therefore, the most effective sorbents comprise soft Lewis acids which effectively coordinate to sulfur. Generally, Lewis acids are defined as species which can accept a share in an electron pair (i.e., an electron pair acceptor). In broad terms, soft Lewis acids are transition metals with six or more electrons, with the $d^{10}$ configuration metals and metal ions exhibiting excellent soft Lewis acid properties. Soft Lewis acids have small highest occupied molecular orbital (HOMO) to lowest unoccupied molecular orbital (LUMO) gaps. The presence of low-lying unoccupied molecular orbitals capable of mixing with the ground state of ligands (adsorbates) accounts for the polarizability of soft atoms. Such mutual polarizability allows distortion of electron clouds to reduce repulsion. Also, with polarizable species synergistically coupled, $\sigma$ donation and $\pi$ backbonding will be enhanced.

Preferred soft Lewis acids include atoms and cations of Ag, Hg, Au, Ni, Co, Cu, Sn, Ga, In, and Pt. In addition, some metal oxides of these preferred metals exhibit excellent soft Lewis acid properties, particularly $Ga_2O_3$ and $In_2O_3$.

It is within the scope of the present invention to form the powder compositions described above into composites comprising a plurality of agglomerated nanocrystalline particles. The composite may be formed by pressing or extruding the nanocrystalline particles into pellets. Remarkably, even though pellet formation may occur at high pressures (50-6, 000 psi), the pellet retains at least about 25% of the total pore volume of the first material prior to agglomeration thereof, more preferably at least about 50%, and most preferably about 90% thereof. Agglomerating or agglomerated as used hereinafter includes pressing together of the adsorbent powder as well as pressed-together adsorbent powder. Agglomerating also includes the spraying or pressing of the adsorbent powder (either alone or in a mixture) around a core material other than the adsorbent powder, including, for example, a binder or filler.

In addition to the above-described composition, it is also within the scope of the invention to provide an effective organosulfur sorbent composition comprising $Ga_2O_3$, $In_2O_3$, SnO or intimate mixtures of $Ga_2O_3.Al_2O_3$, $Ga_2O_3.In_2O_3$, or $In_2O_3.Al_2O_3$. This composition is in the form of nanoparticles having average particle sizes of less than about 15 nm, and more preferably between 2-10 nm. Due to the higher atomic numbers of Ga, In, and Sn, surface areas of these particles will not be as high as for other, lighter metals. However, the particles comprising Ga, In, or Sn should have surface areas of at least 30 $m^2/g$, more preferably between about 50-70 $m^2/g$, and most preferably between 70-120 $m^2/g$. As with the mesoporous particles previously described, these particles also exhibit relatively large pore opening sizes (at least about 4 nm, more preferably at least about 8 nm) and total pore volumes (at least about 0.4 $cm^3/g$, more preferably at least about 0.8 $cm^3/g$).

The adsorbents comprising Ga, In, or Sn are formed by a modified autoclave treatment process (also referred to as an aerogel process) similar to that described by Utamapanya et al., *Chem. Mater.,* 3:175-181 (1991) incorporated by reference herein, with the exception that the present process utilizes lower temperatures because the above materials are less thermally stable when compared to oxides of lighter metals such as $Al_2O_3$. Furthermore, these adsorbents may also be formed into composites comprising a plurality of agglomerated nanoparticles. These composites are very similar to the impregnated metal oxide composites described above and may be formed in a similar manner such as by pressing or extrusion. As with the impregnated metal oxide composites, the composites comprising Ga, In, or Sn present a fibrous crystalline structure which retains a substantial portion of it total surface area (at least about 25%, preferably 50%, most preferably 90%) and pore volume after agglomeration.

Another type of sorbent material within the scope of the present invention is a composite comprising a metal oxide nanoparticle at least partially coated with or intimately intermingled with graphitic carbon. The carbon-coated particles generally comprise a metal oxide core at least partially coated with a carbon shell whereas the intermingled particles are formed by combining carbon aerogels with metal oxide aerogels. Preferred metal oxides are selected from the group consisting of MgO, $CeO_2$, AgO, SrO, BaO, CaO, $TiO_2$, $ZrO_2$, FeO, $V_2O_3$, $V_2O_5$, $Mn_2O_3$, $Fe_2O_3$, NiO, CuO, $Al_2O_3$, ZnO, $SiO_2$, $Ag_2O$, and combinations thereof. The metal oxide adsorbents prior to coating should have an average crystallite size of from about 2-50 nm, preferably from about 3-10 nm, and more preferably from about 4-8 nm.

In terms of pore size, the preferred carbon coated composites should have an average pore diameter of at least about 1 nm, and more preferably from about 3-10 nm. The final coated composite will have an average overall crystallite size of from about 3-60 nm, preferably from about 3-15 nm, and more preferably from about 5-10 nm. Thus, the coating layer will have a thickness of less than about 1 nm, and more preferably of from about 0.3-0.7 nm. The final coated composites will also exhibit a BET multi-point surface area of from about 30-700 $m^2/g$, preferably from about 200-700 $m^2/g$, and preferably from about 400-600 $m^2/g$ (although the heavier metal ions naturally have lower surface areas per gram, such as 30-100 $m^2$). At least about 10%, preferably at least about 30%, and more preferably at least about 50% of the surface area of the metal oxide nanoparticles is coated with the coating layer.

The carbon coated composites comprise from about 50-98% by weight, preferably from about 75-95% by weight, and more preferably from about 80-90% by weight metal oxide nanoparticles, based upon the total weight of the final coated composite taken as 100% by weight. Furthermore, the inventive composites comprise from about 2-50% by weight, more preferably from about 5-25% by weight, and even more preferably from about 10-20% by weight carbon coating layer, based upon the total weight of the final coated composite taken as 100% by weight. The coating layer is graphitic and carbonaceous in nature and will comprise at least about 90% by weight carbon and preferably at least about 98% by weight carbon, based upon the total weight of the coating layer taken as 100% by weight. However, even more preferably, the carbon coating layer is entirely carbon.

In the intermingled carbon composites, graphitic carbon nano-regimes are intimately intermingled with metal oxide nano-regimes thereby allowing physisorption of sulfur compounds in close vicinity of soft Lewis acid sites on the metal oxide.

Methods of sorbing sulfur compounds from a fluid, either liquid or gaseous, according to the present invention comprise the steps of providing a sorbent material comprising any of the compounds and composites described above and contacting the fluid with the sorbent material for sorption of at least a portion of the sulfur compounds therein. Preferably, the contacting step occurs at temperatures between about −40°-150° C., at nearly atmospheric pressure. The sorbent material may also be in the form of pellets of the agglomerated particles described above. Using the present inventive method, it is possible to reduce sulfur compound levels in the fluid from levels as high as 175 ppm to less than about 15 ppm, and preferably less than about 8 ppm.

The sulfur compound, when contacted with the sorbent material, is sorbed both physically (by the porous metal oxide material) and chemically (by the soft Lewis acid sites on the sorbent material). Preferably, sorbent materials according to the present invention are capable of being regenerated, therefore, the chemisorption exhibited at the soft Lewis acid sites should not rise to the level of destructive adsorption (dissociative chemisorption).

Regeneration of the sorbent material may occur by heating a bed of material to between about 100°-250° C. while flowing a clean hydrocarbon solvent over the material. Depending on the sorbant material, more polar solvents such as methanol, ethanol, or acetone may be needed to regenerate the material.

The present invention is particularly suited for removing organosulfur compounds from hydrocarbon fluids, such as, gasoline and diesel fuel. Organosulfur compound contained within these fuels are generally members selected from the group consisting of substituted and unsubstituted, saturated and unsaturated aliphatic, cyclic and aromatic organosulfur compounds. Preferably, the organosulfur compounds are selected from the group consisting of thiophene, dibenzothiophene, dimethyldibenzylthiophene, octanethiol and combinations thereof.

In a preferred embodiment, pellets of adsorbent materials are placed in a housing for treatment of a hydrocarbon fuel in situ, that is, on the vehicle or machine consuming the fuel. Preferably, the housing is in the form of a conventional fuel filter. The fuel filter may be an in-line type filter which is placed at some point in the fuel line between the fuel tank and engine, or a single-connector type filter (similar to a conventional automotive oil filter) which may be attached via a single connector point to the engine. In this particular embodiment, pelletized material is preferred to loose powder material for ease of material containment.

The present invention is also suited for removing $H_2S$ and $SO_2$ from gaseous fluids such as hydrocarbon streams and smokestack effluent.

DETAILED DESCRIPTION OF THE PREFERRED EMBODIMENT

Figure 1:
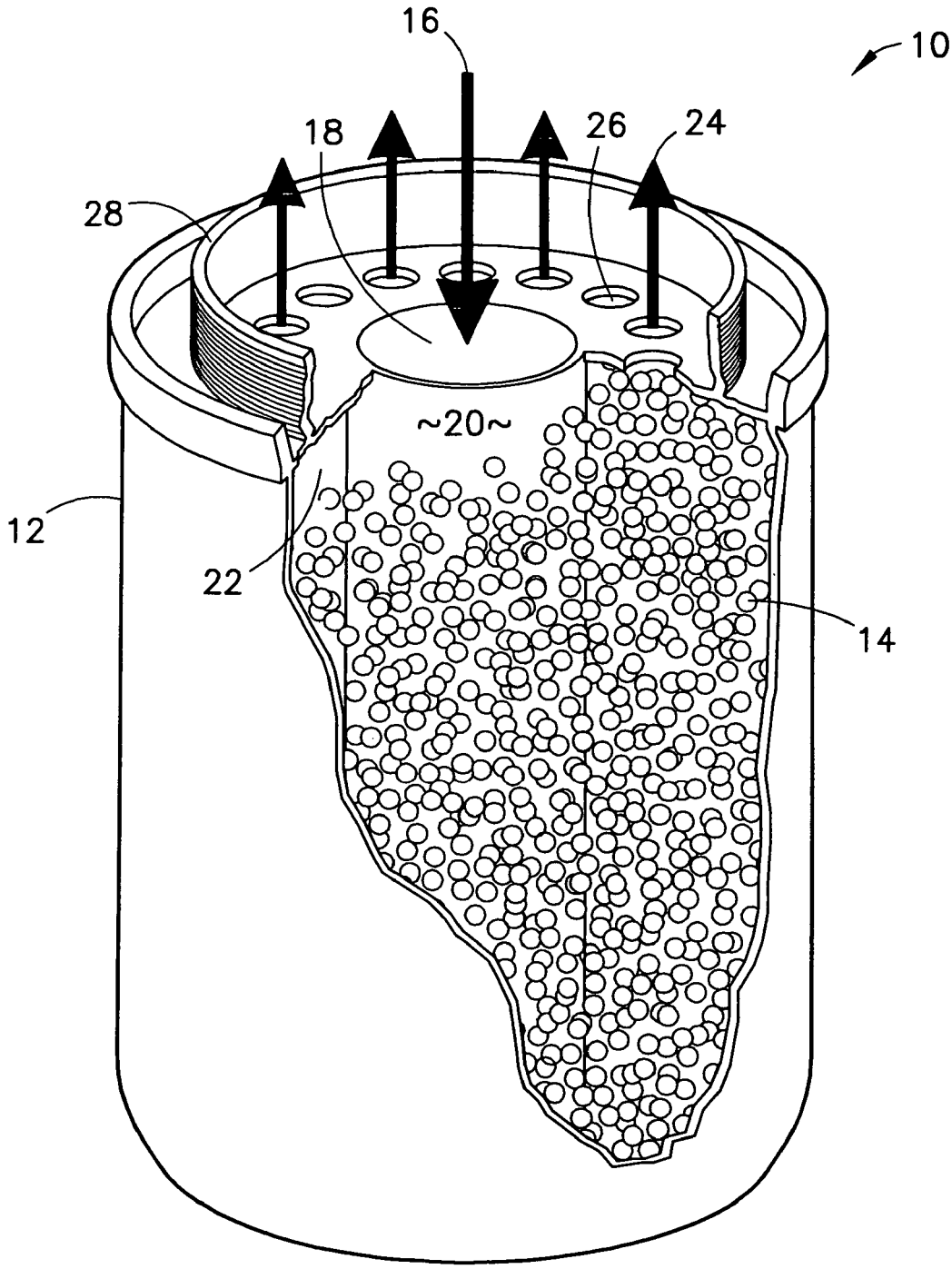
FIG. 1 is a schematic view of a single-connector type fuel filter containing adsorbent material according to the present invention.
Figure 2:
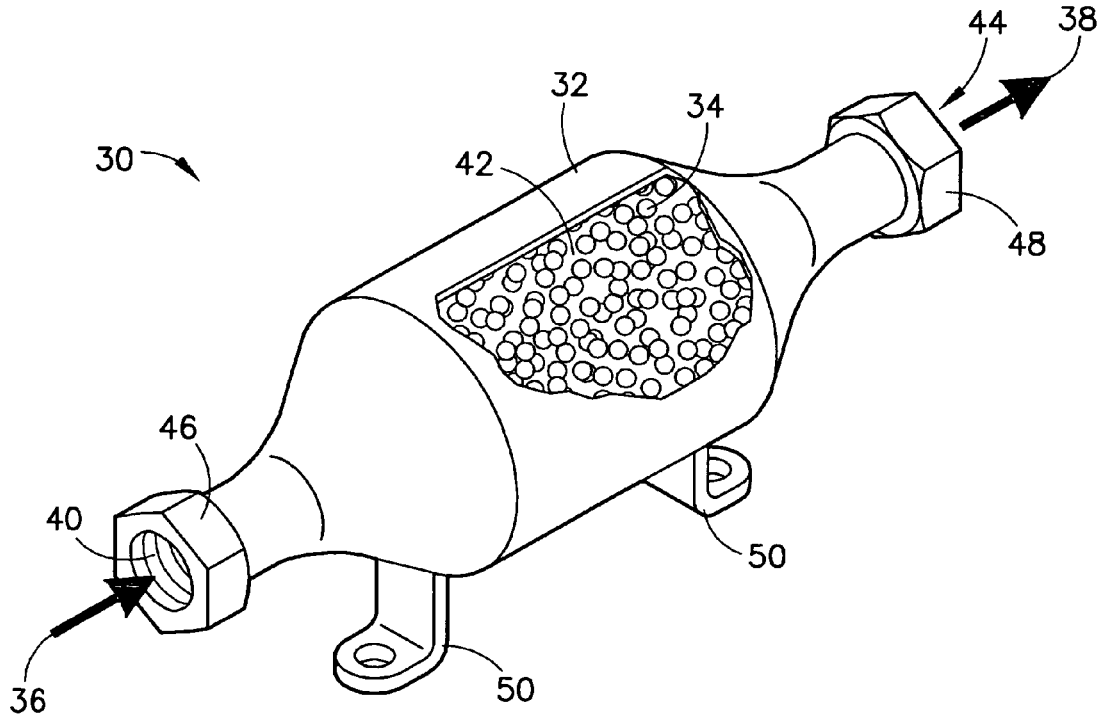
FIG. 2 is a schematic view of an in-line type fuel filter containing adsorbent material according to the present invention.

FIGS. 1 and 2 depict preferred fuel filter embodiments containing adsorbent material in accordance with the present invention. For purposes of illustrating these preferred embodiments, $Al_2O_3$ impregnated with Ag ions (hereafter referred to as Ag-AP-$Al_2O_3$) will be used as the adsorbent material. However, nothing in this illustration should be taken as a limitation upon the overall scope of the invention.

Turning now to FIG. 1 which depicts a single-connector type fuel filter 10 comprising housing 12 having a plurality of sorbent Ag-AP-$Al_2O_3$ pellets 14 located therein. The flow of incoming fuel into filter 10 is indicated by arrow 16. The incoming fuel 16 enters the filter through a central orifice 18 and then flows through cylinder 20 and into chamber 22 where it contacts pellets 14. As the fuel contacts pellets 14, organosulfur contaminants in the fuel are adsorbed by the pellets. The purified fuel denoted by arrows 24 then leaves the chamber 22 (and consequently filter 10) through a plurality of orifices 26.

Filter 10 is equipped with a male threaded ring section 28 which may be received in a corresponding female threaded opening (not shown) of, for example, an engine block. Additionally, solvent resistant gaskets (not shown) may be used with filter 10 in order to properly seal the filter orifices 18, 26 with the engine block so as to avoid leaking.

FIG. 2 depicts another preferred fuel filter apparatus 30 which is suitable for in-line connection. Like the embodiment of FIG. 1, filter 30 comprises a housing 32 having a plurality of sorbent Ag-AP-$Al_2O_3$ pellets 34 located therein. The flow of fuel through the filter is depicted by arrows 36, 38. The fuel enters filter 10 through orifice 40 and enters chamber 42 whereupon it comes into contact with pellets 34. Again, as the fuel contacts pellets 34, organosulfur contaminants in the fuel are adsorbed by the pellets. The purified fuel denoted by arrows 38 then leaves the chamber 42 through orifice 44.

Filter 30 is configured for in-line placement in a fuel delivery system. Filter 30 may be attached directly to the fuel line using connectors 46, 48. Brackets 50 allow filter 30 to be fixedly secured to a solid portion of the vehicle in order to avoid damage to the fuel line or filter attributable to vehicle motion and vibrations.

EXAMPLES

The following examples set forth preferred methods of synthesizing nanocrystalline mesoporous metal oxide compounds in accordance with the present invention. It is to be understood, however, that these examples are provided by way of illustration and nothing therein should be taken as a limitation upon the overall scope of the invention.

Example 1

In this example, nanosized $Al_2O_3$ particles were impregnated with silver ions. In a 250 ml round bottom flask, about 0.2 g of nanosized $Al_2O_3$ (also referred to as AP-$Al_2O_3$) prepared by the aerogel method described by Utamapanya et al., *Chem. Mater.,* 3:175-181 (1991), incorporated by reference herein, 0.11 g of silver acetylacetonate (Aldrich), and 25 ml of tetrahydrofuran (Fisher) were combined. The resulting slurry was stirred at room temperature for about 24 hours and protected from exposure to light with aluminum foil. After stirring, the mixture was centrifuged, washed with tetrahydrofuran approximately 4-5 times to remove excess silver acetylacetonate, and dried in a drying cabinet for about 2 hours. The brown powder that remained was heated at 500° C. under an air atmosphere inside a muffle furnace for about 3 hours. The final product was a brownish black powder and was designated Ag-AP-$Al_2O_3$.

Example 2

This example describes the adsorption of thiophene using Ag-AP-$Al_2O_3$ prepared according to Example 1. To about 0.1 g of Ag-AP-$Al_2O_3$, 10 ml of thiophene solution in pentane ($9.9\times10^{-5}$ M) was added. The sorption of thiophene was allowed to proceed at room temperature for about 15 hours. The degree of thiophene sorption on Ag-AP-$Al_2O_3$ was determined by measuring the UV-V is spectrum of the supernatant solution. Analysis showed that the silver ion impregnated AP-$Al_2O_3$ was successful in scavenging thiophene from the pentane solution.

Example 3

This example relates to impregnation of nanocrystalline MgO with nickel ions ($Ni^{2+}$), the final product being designated $Ni^{2+}$-AP-MgO. In a 250 ml round bottom flask, 0.2 g of nanosized MgO (also referred to as AP-MgO) prepared by the aerogel method, 0.1 g of nickel acetylacetonate, and 25 ml of tetrahydrofuran are combined. The slurry is stirred at room temperature for about 24 hours. The mixture is centrifuged, washed with tetrahydrofuran, and dried in a drying cabinet for about 2 hours. The resulting powder undergoes calcination for about 3 hours inside a muffle furnace at 500° C. initially under an air atmosphere switching over to a vacuum. $Ni^{2+}$-AP-$Al_2O_3$ may be prepared in a similar manner by substituting AP-$Al_2O_3$ for MgO. Similarly, $Cu^+$, $Au^+$, $Ga^{3+}$, and $In^{3+}$ may be substituted for $Ni^{2+}$ in this process and the metal oxide impregnated therewith.

Example 4

This example describes impregnation of a nanocrystalline metal oxide with a second metal oxide which exhibits the properties of a Lewis acid. Specifically, this example describes the impregnation of $Al_2O_3$ with $Ga_2O_3$ (the Lewis acid). In a 250 ml round bottom flask, 0.2 g of nanosized $Al_2O_3$ (also referred to as AP-$Al_2O_3$) prepared by the aerogel method, 0.1 g of gallium acetylacetonate, and 25 ml of tetrahydrofuran are combined. The slurry is stirred at room temperature for about 24 hours. The mixture is centrifuged, washed with tetrahydrofuran to remove the excess gallium acetylacetonate, and dried in a drying cabinet for about 2 hours. The resulting powder undergoes calcination for about 3 hours inside a muffle furnace at 500° C. under an air atmosphere. It is important to note that MgO may be substituted for $Al_2O_3$ and indium acetylacetonate for gallium acetylacetonate with little modification of the overall method.

Example 5

This example pertains to the preparation of nanocrystalline $Ga_2O_3$ having a high surface area useful as a sorbent for thiophene removal from a fluid. In this procedure, 7% by weight gallium ethoxide in ethanol solution is prepared and 63% by weight toluene solvent is added. The solution is then hydrolyzed by the addition of 0.5% by weight water dropwise while the solution is stirred and covered with aluminum foil to avoid evaporation. To ensure completion of the reaction, the mixture is stirred overnight. This produces a gel which is treated in an autoclave using a glass lined 600 ml capacity Parr miniature reactor. The gel solution is placed in the reactor and flushed for 10 minutes with nitrogen gas, whereupon the reactor is closed and pressurized to 100 psi using nitrogen gas. The reactor is then heated up to 265° C. over a 4 hour period at a heating rate of 1° C./min. The temperature is equilibrated at 265° C. for 10 minutes (final reactor pressure is about 900 psi). At this point, the reactor is vented to release the pressure and vent the solvent. Finally, the reactor is flushed with nitrogen gas for 10 minutes. The resulting $Ga(OH)_3$ particles undergo calcination and are converted to $Ga_2O_3$. The calcination proceeds for about 6 hours under an air atmosphere up to a maximum temperature of 500° C.

The indium ethoxide may be substituted for gallium ethoxide in the preceding method for production of $In_2O_3$.

We claim:

1. A method of sorbing sulfur compounds from a fluid comprising the steps of:

providing a sorbent material comprising a member selected from the group consisting of:

(a) a composition including a porous first material impregnated with a second material, said first material selected from the group consisting of metal oxides and metal hydroxides having a crystallite size of less than about 15 nm, and said second material selected from the group consisting of metals, metal cations, and metal oxides, (b) a composition selected from the group consisting of $Ga_2O_3$, $In_2O_3$, SnO, $Ga_2O_3.Al_2O_3$, $Ga_2O_3.In_2O_3$, and $In_2O_3.Al_2O_3$ and having an average particle size between about 3-30 nm, (c) a composite comprising a metal oxide nanoparticle at least partially coated with or intimately intermingled with graphitic carbon, said metal oxide nanoparticle having an average crystallite size of from about 2-50 nm, and (d) mixtures of (a)-(c); and contacting the fluid with said sorbent material for sorption of at least a portion of the sulfur compounds therein.

2. The method of claim 1, wherein said sorbent material is in the form of pellets of agglomerated particles of (a), (b), (c), or (d).

3. The method of claim 1, wherein said porous first material is selected from the group consisting of MgO, $CeO_2$, AgO, SrO, BaO, CaO, $TiO_2$, $ZrO_2$, FeO, $V_2O_3$, $V_2O_5$, $Mn_2O_3$, $Fe_2O_3$, NiO, CuO, $Al_2O_3$, ZnO, $SiO_2$, $Ag_2O$, and combinations thereof.

4. The method of claim 1, wherein said second material being a soft Lewis acid.

5. The method of claim 4, wherein said second material is selected from the group consisting of Ag, Hg, Au, Ni, Co, Cu, Sn, Ga, In, Pt, and cations and oxides thereof.

6. The method of claim 1, wherein said porous first material having a surface area of at least about 100 $m^2/g$.

7. The method of claim 1, wherein said porous first mateiial having a pore volume of at least about 0.3 $cm^3/g$ and an average pore opening size of at least about 4 nm.

8. The method of claim 1, wherein said sorbent material is (b) and has a surface area of at least about 100 $m^2/g$.

9. The method of claim 1, wherein said sorbent material is (b) and has a pore volume of at least about 0.2 $cm^3/g$ and an average pore opening size of at least about 4 nm.

10. The method of claim 1, wherein said carbon coated composite comprising a metal oxide selected from the group consisting of MgO, $CeO_2$, AgO, SrO, BaO, CaO, $TiO_2$, $ZrO_2$, FeO, $V_2O_3$, $V_2O_5$, $Mn_2O_3$, $Fe_2O_3$, NiO, CuO, $Al_2O_3$, ZnO, $SiO_2$, $Ag_2O$, and combinations thereof.

11. The method of claim 1, wherein said sorbent material is (c), said metal oxide nanoparticle having a surface area of from about 30-700 $m^2/g$.

12. The method of claim 1, wherein said sorbent material is (c), said metal oxide nanoparticle having a pore volume of at least about 0.2-1.0 $cm^3/g$ and an average pore opening of at least about 4 nm.

13. The method of claim 1, wherein said sulfur compound is selected from the group consisting of $H_2S$, $SO_2$, and organosulfur compounds.

14. The method of claim 13, wherein said organosolfur compound is selected from the group consisting of substituted arid unsubstituted, saturated and unsaturated aliphatic, cyclic and aromatic organosulfur compounds.

15. The method of claim 1, wherein said organosulfur compound is selected from the group consisting of thiophene, dibenzothiophene, dimethyldibenzylthiophene, octanethiol and combinations thereof.

16. The method of claim 1, wherein said fluid comprising a hydrocarbon fluid.

17. The method of claim 16, wherein said fluid comprising a member selected from the group consisting of gasoline and diesel fuel.

18. A method of sorbing sulfur compounds from a fluid comprising the steps of:

providing a composite sorbent material comprising a plurality of agglomerated nanocrystalline particles selected from the group consisting of $Ga_2O_3$, $In_2O_3$, and mixtures thereof, said composite retaining at least about 25% of the total pore volume of said particles prior to agglomeration thereof; and contacting the fluid with said sorbent material for sorption of at least a portion of the sulfur compounds therein.

19. The method of claim 18, wherein said particles having a surface area between about 30-700 $m^2/g$.

20. The method of claim 18, wherein said particles present a pore volume of at least about 0.2 $cm^3/g$ and an average pore opening size of at least about 4 nm.

* * * * *